United States Patent [19]

Uyeda

[11] 4,147,912

[45] Apr. 3, 1979

[54] SHAPED ANTENNA FOR ENERGY DISTRIBUTION IN A MICROWAVE COOKING CAVITY

[75] Inventor: Frederick K. Uyeda, Attica, Ind.

[73] Assignee: Roper Corporation, Kankakee, Ill.

[21] Appl. No.: 765,967

[22] Filed: Feb. 7, 1977

[51] Int. Cl.[2] ..... H05B 9/06

[52] U.S. Cl. ..... 219/10.55 F; 219/10.55 M

[58] Field of Search ..... 219/10.55 F; 343/749, 343/752, 899, 772, 783, 789, 829, 830, 831, 828

[56] References Cited

U.S. PATENT DOCUMENTS

| | | | |
|---|---|---|---|
| 2,239,724 | 4/1941 | Lindenblad | 343/831 |
| 2,267,889 | 12/1941 | Aubert | 343/830 |
| 2,493,514 | 1/1950 | Wehner | 343/828 |
| 2,648,760 | 9/1953 | Hall et al. | 219/10.55 F |
| 2,658,145 | 11/1953 | Dorne et al. | 343/772 |
| 2,659,003 | 11/1953 | Dorne et al. | 343/828 |
| 2,724,052 | 11/1955 | Boyer | 343/830 |
| 3,001,194 | 9/1961 | Leppert | 343/896 |
| 3,798,404 | 3/1974 | Simon et al. | 219/10.55 F |
| 4,030,101 | 6/1977 | Satoh | 343/896 |

FOREIGN PATENT DOCUMENTS

| | | | |
|---|---|---|---|
| 1227096 | 10/1962 | Fed. Rep. of Germany | 219/10.55 |

*Primary Examiner*—Arthur T. Grimley
*Assistant Examiner*—Bernard Roskoski
*Attorney, Agent, or Firm*—Leydig, Voit, Osann, Mayer & Holt, Ltd.

[57] ABSTRACT

A static antenna system using a monopole shaped to deliver and evenly distribute microwave energy in a desired pattern. The monopole is symmetrical with respect to its axis, and the cross sectional area taken in planes perpendicular to the axis is varied to control the shape and location of the radiated pattern. The resulting even energy distribution is accomplished without the need for moving parts of any kind.

18 Claims, 20 Drawing Figures

SHAPED ANTENNA FOR ENERGY DISTRIBUTION IN A MICROWAVE COOKING CAVITY

Figure 1:
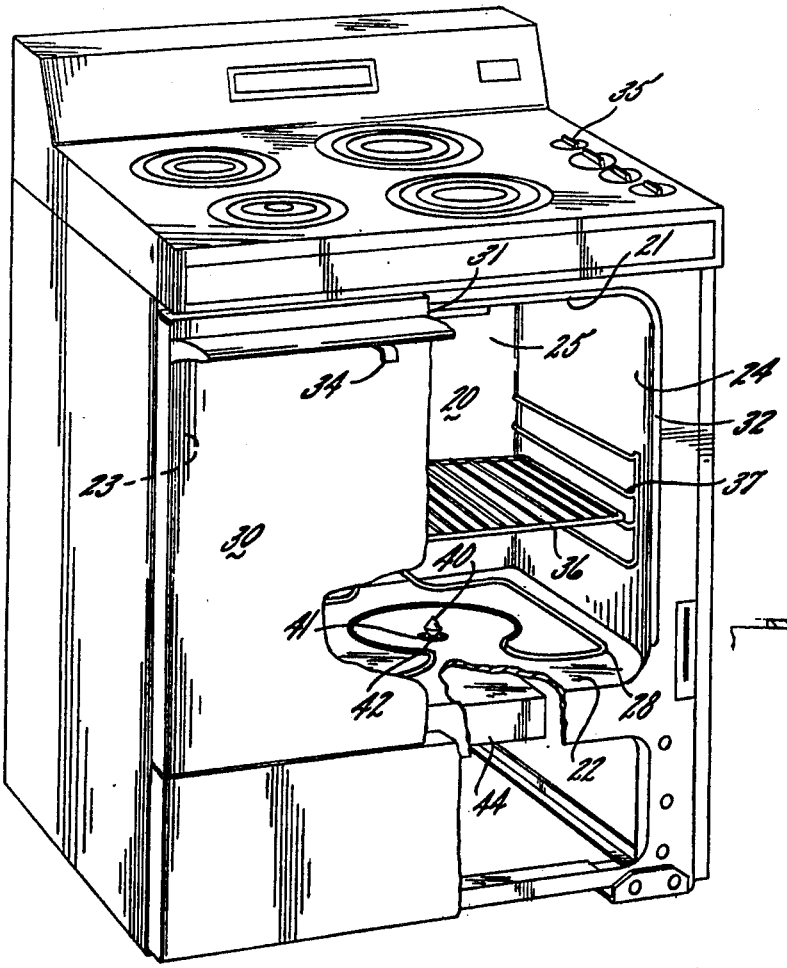

This invention relates to microwave heating apparatus and more particularly to a static antenna in such apparatus for delivering and evenly distributing microwave energy.

In using microwaves for heating or cooking, the problem exists of coupling the energy into the heating cavity and evenly distributing the energy in the portion of that cavity in which the load is to be located. Microwave ovens have employed numerous types of feed and distribution systems in order to equalize energy distribution so that the foodstuff placed in the oven as the heating load is uniformly heated for even cooking. Typical prior art attempts to satisfy this requirement have treated the coupling of energy to the cavity and the distribution of energy therewithin as separate problems, and as a result, have met with only marginal success.

In a typical system all or most of the energy is simply dumped into the cavity, either with or without the use of an antenna, resulting in the setting up of standing waves in modes which depend upon the physical dimensions and proportions of the cavity. Usually this causes the production of localized hot spots and cold spots. If these hot spots or cold spots fall within the volume which the cooking load is to occupy, uneven cooking will resutl.

In order to alleviate this problem, that is to minimize the effect of uneven energy distribution, it has been common practice to employ rotating devices within the cavity. Most typically a rotating mode stirrer is placed within the cavity, the mode stirrer having blades and being motor driven for cyclically varying the modes to shift the hot spots and more evenly distribute the heating effect. Rotating food support trays have also been utilized to actually move the food load within the cavity. Rotating antennas have also been employed. Each of these approaches introduces motors, couplings, and other complications, increasing the cost and reducing reliability of the overall system.

Generally, in prior art systems which treat coupling and distribution as separate problems, reflected energy is heavily relied on to perform the cooking. Such energy is reflected not only from the walls of the cavity itself, but also from stirring devices, and, in some cases, from reflectors purposefully positioned within the cavity.

One prior art approach to coupling and distributing energy in a microwave oven is that shown in Simon et al. U.S. Pat. No. 3,798,404. The antenna used therein is described as a slightly concave disc-like capacitive member. The abrupt juncture inherent in this antenna tends to clock primary energy, forcing reliance on relatively uncontrollable random reflected energy. It is apparent from the specification that the antenna is merely the coupling means to deliver energy to the oven, energy control or distribution being accomplished by the mode exciter to which the patent is directed. The blocking of primary radiation is further apparent from the diameter of the mushroom antenna, one quarter wavelength at 915 mHz. being over three inches, a dimension considerably greater than the infeed aperture.

In view of the foregoing, it is a general aim of the present invention to provide a static antenna system for coupling energy to a microwave cavity and for evenly distributing energy within a predetermined volume in said cavity. In that regard, it is an object to provide such an antenna having guidance surfaces keyed to the volume to be occupied by the load so as to maximize direct radiation to the volume, thereby minimizing dependence on reflected energy and hence on the cavity geometry.

A detailed object of the invention is to provide a static antenna feed system for a microwave oven wherein the radiating element of the antenna includes a base portion shaped as an energy spreader and a tip portion shaped as an energy concentrator, the shapes of the respective base and tip portions being keyed to the volume to be occupied by the cooking load.

It is a resulting object of the present invention to provide a microwave oven of high reliability wherein the energy coupling and distribution system require no moving parts.

Finally, an object of the invention is to provide a method of distributing microwave energy within a predetermined volume by shaping base and tip members of a radiating antenna element to guide primary energy to the predetermined volume.

Figure 2:
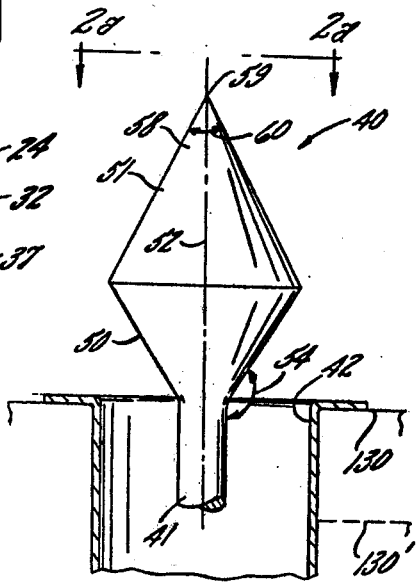
Figure 2A:
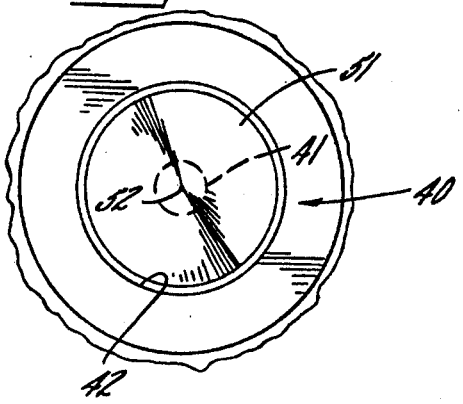

Other objects and advantages will become apparent from the following detailed description when taken in conjunction with the drawings in which:

FIG. 1 is a perspective view showing a microwave oven having an antenna system exemplifying the present invention;

FIGS. 2 and 2*a* are elevational and plan views, respectively, showing the general case of a shaped antenna;

FIGS. 3*a*–3*d* schematically illustrate spreader-concentrator shaped antennas and the result produced thereby;

FIGS. 4*a*–4*d* schematically illustrate blunted spreader shaped antennas and the result produced thereby;

FIGS. 5*a*–5*d* schematically illustrate concentrator type shaped antennas and the result produced thereby; and FIGS. 6*a*–6*e* schematically illustrate blunted concentrator type shaped antennas and the result produced thereby.

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Turning now to the drawings, FIG. 1 shows a typical free standing electric range to which the present invention has been applied. The range has an oven cavity 20 including a top wall 21, a bottom wall 22, side walls 23, 24 and a back wall 25. The oven may be equipped with resistance heating elements, one of such elements 28 being shown positioned a short distance above the bottom wall 22. The oven cavity is closed by a hinged door 30 having a gasket 31 which provides continuous and unbroken engagement with a land surface 32 on the range body. The gasket is of the type intended for shielding against escape of thermal and microwave energy.

The range may be equipped with well known provision for high temperature slef-cleaning. Consequently, a latch is provided having a latching control 34, with the mode of operation being selectable by a mode switch 35 at the top of the range. Within the oven cavity is a grid type shelf 36 formed of metallic conductors in spaced parallel relation and extending horizontally over the entire area of the cavity. Metallic brackets 37 at either end of the cavity support the shelf.

It will be appreciated that the walls and door define a cavity, at least a portion of which is adapted to receive a food load for cooking. The portion of the cavity designated as the load receiving volume is determined, in part, by the location of the shelf 36, whether such shelf is fixed in position or movable, the portion of the shelf area which may receive a food load, and the usable space above the shelf which can accommodate foodstuff to be cooked. It is this predetermined volume to which microwave energy must be evenly distributed in order to assure uniform cooking. It should be noted at this point, as will be emphasized below, that the illustrated oven is merely an exemplary environment for an antenna according to the invention. The antenna may be configured to provide energy distribution within other sizes and shapes of cavity, this feature being an important aspect of the present invention.

In accordance with the invention, a static antenna system is provided for coupling energy to the cavity, and is shaped to evenly distribute the energy to the load receiving volume. The radiating member of the static antenna system is monopole antenna 40, which in the present instance projects through the bottom wall 22, approximately centrally thereof. The antenna 40, in the present instance, is supplied with microwave energy by a coaxial feed system including inner cylindrical conductor 41 and outer cylindrical conductor 42. Typically the microwave energy is produced by a magnetron and coupled to the antenna by a transmission line or waveguide; the waveguide portion 44 is intended to represent both the source and the coupling means. It should also be noted that it is possible to employ an antenna according to the invention as the radiating member of the magnetron, itself, eliminating the need for any coupling means. In the illustrated embodiment, energization of the microwave source or magnetron causes the production of microwave energy which is coupled via the waveguide 44 to the coaxial feed system 41, 42, the radiating member 40 serving to distribute energy within the cavity 20, in a volume determined by the particular shape of the member 40. It is emphasized that this distribution is accomplished without the need for moving elements of any sort.

Turning now to FIGS. 2 and 2*a*, the structure and mode of operation of a shaped antenna according to the present invention will be described. The center conductor 41 and outer cylindrical conductor 42 described in connection with FIG. 1 as a coaxial feed system are illustrated. The radiating member 40, extending into the oven cavity includes a base portion 50 and a tip portion 51. It is seen that the radiating member 40 shares the axis 52 of the center conductor 41, and is therefore coaxial with the outer conductor 42. As shown in FIG. 2*a*, the shaped member in plan is circular, with any plane taken perpendicular to the axis defining a circle and therefore a diameter. In practicing the invention the respective diameters are varied along the antenna axis to control the pattern of energy radiated from the antenna.

The base portion 50 joins the center conductor 41 and forms therewith an angle 54. At one limit, the angle 54 should be no smaller than 90°, and preferably about 105° or more. At the other limit, the angle 54 should be no greater than 180°, for which case the base portion forms an extension of the center conductor 41. The base portion 50 tends to spread the energy in a planar area perpendicular to the axis of the antenna. This is a useful controlling element where the food load is positioned relatively close to the antenna. An additional facet of the spreader is the ability to supply indirect radiation to the food load surface facing away from the antenna. In general, to increase the spreading effect the size of the angle 54 is decreased to provide a sloping shouldered portion rising gradually from the center conductor 41.

The tip member 51 is shaped and is keyed to the shape of the base portion to determine the radiated pattern. As shown, the outer surface of the tip indicated at 58 merges toward a point 59 on the axis 52, forming an included angle 60 which is in the range between 20° and 150°. Decreasing the size of the angle, that is making the tip more sharply pointed, tends to concentrate energy in the central area of the cavity. Tips of sharply pointed construction are useful in obtaining adequate center energy, especially when the load is located at an appreciable distance from the radiating antenna. Decreasing the sharpness of the point, that is increasing the size of the angle 60 tends to reduce the concentrating effect. It should also be noted that it is possible to blunt the tip portion so that the surface 58, while merging toward the point 59, does not actually intersect such point, the tip being blunted for energy control as will be described below.

Finally, the maximum diameter of the radiating portion should be no greater than the diameter of the outer cylindrical conductor 42, or other infeed aperture, so that the radiating portion may serve to guide rather than block energy for distribution within the cavity. In systems constructed to operate at 2450 mHz, this constraint limits the maximum antenna diameter to about 1.5 inches.

The shaped antenna thus constructed is generally circular (though of varying diameter) in plan, is coaxial with the infeed system, with the diameters of the circular sections varying along the length of the axis. In other words, the cross sectional area of the radiating portion is varied along the axis thereof for the purpose of varying a guidance boundary, and thus directionalizing the energy.

With that background in mind, various antenna shapes constructed in accordance with the foregoing teachings will be examined in conjunction with the energy patterns produced thereby. Referring first to FIGS. 3*a*–3*d*, there are shown exemplary configurations of shaped antennas employing spreaders in combination with concentrators. The antenna 70 illustrates the approach wherein the base portion is formed as a spreader and diverges fairly sharply at 71 from the inner conductor. The base portion smoothly merges into the tip portion at 72, the tip being sharply pointed to achieve a concentrator effect.

The antenna 73 illustrates a slightly different approach wherein the base portion diverges in a smooth curve as at 74 from the inner conductor. In this cae, in order to meet the requirement that the angle formed between the center conductor and the external surface of the base portion be in the range between 90° and 180°, it is important that the curve not "double back on itself". That is, a tangent drawn to the surface of the base portion at any point thereof must intersect the axis of the center conductor at an angle within the specified range.

Figure 3A:
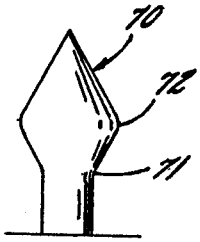
Figure 3B:
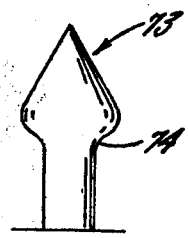
Figure 3C:
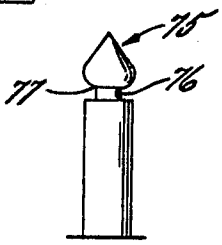

FIG. 3*c* illustrates a still further variation, and introduces the concept of a sharp discontinuity 76 in the radiating portion of the antenna 75. While abrupt shape changes as illustrated are difficult to rationalize by classical guidance theory, in practice, they tend to enhance the spreading effect to distribute energy over a large planar area. Conceptually a discontinuity such as 76 may be formed in any portion of the radiating surface. But I have found it most useful to form such discontinuity in the center conductor itself, below the base portion. While the discontinuity does, in fact, radiate, it will be treated herein as formed in the portion of the center conductor extending into the cooking cavity. The base portion, and its departure from the center conductor will therefore be defined as before. Thus, in FIG. 3*c* the base portion begins at the point labeled 77.

Figure 3D:
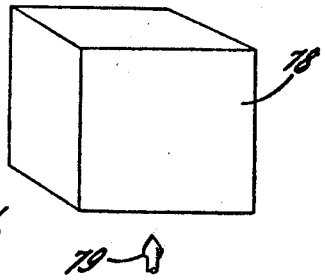

FIG. 3*d* schematically illustrates the type of distribution coverage 78 achieved with the spreader-concentrator configurations 79 as represented by those in FIGS. 3*a*–3*c*. It is seen that the pattern covers a large planar area due to the spreader configuration (or discontinuity when present), and that such area extends for a substantial height due to the concentrator to cover a comparatively large volume. Furthermore, the volume is fairly closely spaced to the antenna. Such an antenna shape is very adaptable to the oven configuration illustrated in FIG. 1 which exhibits a rather large cubical volume in which foodstuffs may be disposed for cooking.

The spreader-concentrator configurations represented in FIG. 3 prove to be quite useful in application because of the comparatively large radiated volume. The spreading effect achieved mainly by the base portion is balanced against the concentrating effect achieved by the tip portion by adjusting the respective angles, surface shapes, and overall antenna length. In general the configuration is characterized by a base portion which diverges from the center conductor to a plane of maximum diameter, a tip portion which converges from the plane of maximum diameter to an apex on the antenna axis, with the base and tip portions being joined at the plane of maximum diameter.

Figure 4A:
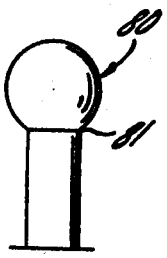
Figure 4B:
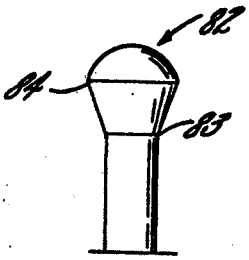
Figure 4C:
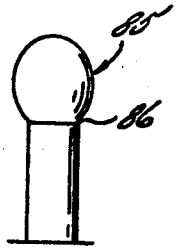
Figure 4D:
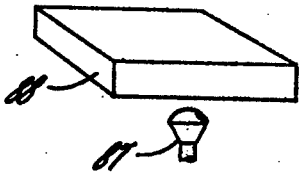

FIGS. 4*a*–4*d* illustrate blunted spreader configurations wherein the base is configured as a spreader not unlike those shown in FIG. 3, but the tip portion is blunted to minimize the concentrating effect. Turning to FIG. 4*a*, for example, it is seen that the shaped antenna 80 has a base portion which diverges rather sharply from the center conductor at 81 but then smoothly curves toward the tip portion, such curve being continued through the tip portion to form a spherical blunted surface. In cases where the tip portion is curved or blunted, the included angle described above is that measured between lines tangent to the tip surface, such lines being tangent at points approximately midway between the axis and the major diameter of the tip portion. In this way, it is seen that the surface of the tip portion converges toward a point on the antenna axis although, due to the curved surface, it never reaches that point. Blunting the tip portion in this way serves to minimize the concentrating effect, providing an antenna which distributes energy mainly as determined by the spreader portion, that is in a relatively large planar area but closely spaced to the antenna as illustrated in FIG. 4*d*.

FIG. 4*b* illustrates a further blunted spreader 82 wherein the base portion diverges at 83 in a linear path from the center conductor. The blunted tip portion joins the base portion at the point of greatest diameter 84 and, much as in FIG. 4*a*, is smoothly curved to minimize the concentrating effect. FIG. 4*c* shows a further illustrative blunted spreader 85, somewhat elliptical in configuration wherein the base portion diverges somewhat sharply from the center conductor at 86 and follows a relatively smooth elliptical curve through the tip portion to form a blunted spreader. As noted above, such blunted spreaders 87 serve to provide an energy distribution as at 88 which covers a rather large planar area, but is closely spaced to the radiating antenna. The energy distribution patterns thus achieved may be useful, for example, in portable microwave ovens using bottom feed wherein the food load is generally relatively close to the antenna element. In general, the blunted spreader configuration is characterized by a base portion which diverges from the center conductor to a plane of maximum diameter and a tip portion in the form of a smooth curve joining the base portion at the plane of maximum diameter to terminate in a blunted curved surface on the antenna axis.

Figure 5A:
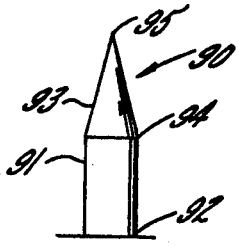

Turning now to FIGS. 5*a*–5*d*, there are shown exemplary forms of concentrators, for example the speared concentrator 90 shown in FIG. 5*a*. In this case, the angle formed between the base portion 91 and the inner conductor 92 is at its maximum, that is 180° so that the base portion, in effect, merely forms an extension of the center conductor. This minimizes the spreading effect, thus minimizing energy distribution in the large planar area near the antenna itself. The tip portion 93, in the example of FIG. 5*a*, diverges relatively sharply from the base portion at 94 to meet in a sharp apex 95 on the axis of the antenna.

Figure 5B:
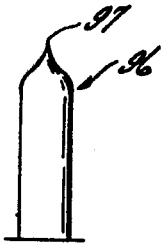

FIG. 5*b* shows a variation in the form of a pointed ogive 96, wherein the tip portion has a curvature which becomes very sharp as the axis is approached to terminate in a very sharp point 97. As in the case of FIG. 5*a*, and 5*c* to be described shortly, the base portion and center conductor meet at an angle of about 180°.

Figure 5C:
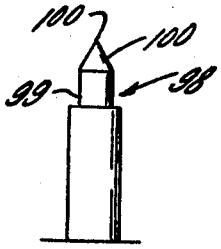
Figure 5D:
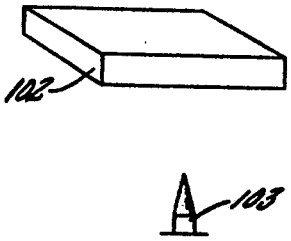

The cone type concentrator 98 of FIG. 5*c* shows the applicaton of a sharp discontinuity to the concentrator family. In this case the base portion 99 is parallel to the axis of the antenna, thereby forming an angle of 180° therewith, and the tip portion 100 converges sharply therefrom to meet in a sharply pointed apex 101. In the case of concentrators as exemplified by FIGS. 5*a*–5*c*, the energy distribution typically covers a large planar area 102 well spaced from the antenna 103. The energy pattern achieved is usable, for example, in portable microwave ovens employing top feed wherein the food load covers a reasonably large area, but as compared to the area is somewhat distant from the radiating antenna. In general the concentrator family is characterized by a base portion in the form of an extension of the center conductor, and a tip portion which converges from the base portion to an apex on the antenna axis.

Figure 6A:
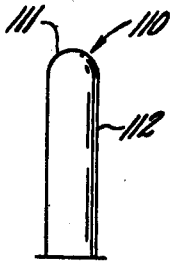
Figure 6B:
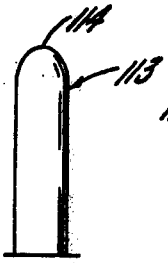
Figure 6C:
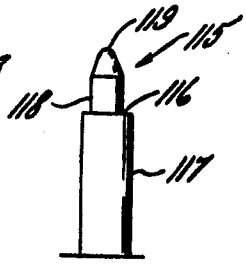
Figure 6D:
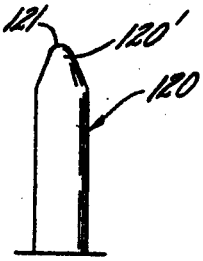
Figure 6E:
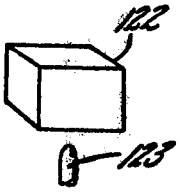

Blunted concentrators, exemplary ones of which are depicted in FIGS. 6*a*–6*e*, show a further variation in shaped antennas, constructed in accordance with the present invention. As in the case of the concentrators shown in FIG. 5, the base portion in blunted concentrators is formed as an extension of the center conductor, that is, the surface of the base portion and the surface or axis of the center conductor form an angle of about 180°. In FIG. 6*a*, the spherical blunted concentrator 110 has a tip portion in the form of a sphere 111 positioned atop the base portion 112. Blunted concentrator 113 of FIG. 6*b* has a generally elliptical tip portion 114. FIG. 6*c* illustrates a blunted concentrator 115 incorporating a discontinuity 116 intermediate the center conductor 117 and the base portion 118 and having a generally elliptical tip portion 119 not unlike that shown in FIG. 6b. The blunted concentrator 120 of FIG. 6d has a generally conical tip portion 120' with the apex of the cone being blunted at 121. It can generally be stated for blunted concentrators that the energy distribution pattern covers a comparatively small cubical volume 122, small in both planar area and height, the cubical volume 122 being relatively proximate the antenna 123. Such a configuration is useful, for example, in extremely compact portable ovens wherein the cooking volume is relatively small and is positioned relatively close to the radiating antenna. In general the family is characterized by a base portion which forms an extension of the center conductor and a tip portion which converges in a relatively continuous manner to terminate in a rounded or blunted surface on the antenna axis.

The preceding paragraphs have dealt at length with the manner in which the shape of an axially symmetrical antenna, that is its cross sectional area in planes perpendicular to its axis, may be varied to control the pattern of energy distribution in a microwave oven. A further factor which may be used in conjunction with this approach is varying thedepth of penetration of the outer cylindrical conductor into the microwave cavity. Referring again to FIG. 2a, the outer conductor 42 may be positioned so that it terminates substantially flush with the cavity wall 130. However, the feed system may also be arranged so that the outer conductor 42 projects into the microwave cavity, as illustrated by dotted cavity wall 130' in FIG. 2. I have found that increasing the amount of penetration generally increases the proportion of center energy in the pattern, and may thus be used to alter a particular distribution pattern achieved with a given antenna shape. I have also found that flaring the outer conductor serves to decrease the amount of center energy, thus providing a further control on the distribution pattern. A further variable is provided by the length of the center conductor which projects into the cavity between the termination of the outer conductor and the commencement of the base portion.

In the schematic illustrations of FIGS. 3–6, the antenna profile was shown only in elevation, and the outer cylindrical conductor omitted. It will be recalled, however, that the constraint whereby the maximum diameter of the antenna portion is no greater than the diameter of the outer cylindrical conductor or other infeed aperture must be observed in each of these cases. With this fact in view, it will be appreciated that the maximum allowable antenna diameter is on the order of 1.5 inches. As noted briefly above, the shaped antenna taught herein may be applied directly to the magnetron to form the radiating member thereof. In this case, the antenna joined to the magnetron output feed conductor will directly project into the cooking cavity, eliminating the need for waveguides, transmission lines or the like.

In the case of applying the antenna directly to the magnetron, the outer cylindrical conductor may be eliminated, and the antenna located to simply project through an aperture in the oven wall. The aperture is typically circular, although it need not be. In any case, the maximum diameter of the antenna must be less than the aperture size as measured on any line intersecting the antenna axis. The aperture approach may also be used with a waveguide feed system wherein an aperture in the oven wall communicates with the waveguide, allowing the antenna element to project therethrough. In this case, the portion of the cylindrical conductor which projects into the waveguide acts as a pickup probe, coupling energy to the shaped antenna within the cavity. In short, the means of delivering energy to the antenna may be varied, the important aspect of the invention being the shaping of the antenna to evenly distribute such energy within the cavity.

It will now be apparent that the many antenna configurations discussed in detail above are merely exemplary of the shapes achievable in practicing the present invention, and are offered to illustrate the method by which the invention is practiced. Rather than focusing on any particular shape, it is important to note that in practicing the invention, the radiating portion of the antenna is made concentric with the coaxial infeed, is no larger in diameter than the outer conductor, and has a cross sectional area which is varied along the axis of the antenna to produce a pattern compatible with the load volume to be radiated. The base portion of the antenna joins the center conductor and forms a first angle therewith, and the tip portion is on the base and merges toward a point on the antenna axis to form a second included angle, the angles (as well as the overall shapes) being related to provide primary energy distribution over the desired volume. Generally, if a large planar area is to be covered, and especially near the antenna itself, the base portion is formed as a spreader, with the first angle mentioned above decreasing from its maximum at 180° toward its minimum of 90°, but in the typical case preferably no less than 105°. In order to achieve greater center energy distribution, the tip portion is made pointed, that is, the second angle is adjusted from its maximum of 130° toward its minimum of 20°. The respective angles as well as the overall antenna length are balanced in accordance with the foregoing principles to achieve the pattern necessary for a particular application.

Stated differently, the antenna is shaped to radiate a predetermined volume by diverging the base portion from the center conductor by an amount sufficient to spread the energy to cover the planar area of the volume near the antenna; the tip portion is converged toward the antenna axis by an amount and at a rate sufficient to concentrate energy in the center portion of the volume; and the divergence and convergence are balanced against each other to obtain a substantially uniform distribution of energy in the predetermined volume.

In configuring an antenna according to the present invention an important factor which must be considered is obtaining adequate center energy, a problem which becomes especially significant when the load is located some distance from the radiating antenna. If the load is near the antenna, or is of large volume, the blunted spreader or spreader-concentrator configurations, respectively are usable. However, in order to radiate a load which is distant from the antenna, the antenna configuration would be changed from a short conical guiding tip to a blunted version of the speared concentrator. If even greater distance is required, the degree of blunting should be minimized, with the pointed tip providing good center energy at a relatively large distance and the pointed ogive usable for loads well spaced from the antenna.

A second factor which must be balanced against the first is the broadening of the planar area energy distribution, not only when the load is located fairly proximate the antenna, but also to supply sufficient indirect radiation to the food load surface facing away from the antenna. This is achieved either by guidance as exemplified in the spreader configurations, or by utilization of abrupt discontinuities.

It will now be appreciated that load proximity to the antenna and the volume to be radiated are the determining factors for the final antenna shape, and the oven configuration, due to the minimal reliance on indirect radiation, is of lesser significance.

I have attempted by classical antenna theory to devise an explanation for the operation of the antenna configuration taught herein. A likely theory involves guidance concepts wherein a gradual change in the guiding boundary (that is the antenna surface) will cause a directional change in the propagated wave. In this way, wave propagation is directionalized to cover the desired volume. This theory appears to apply to the speared concentrator and conical spreader configurations. A further potential theory is that by varying the surface shape of an incremental element of the antenna length with respect to its axis, the current waveform along the antenna length is varied, thereby varying the radiation field in a desirable manner. This may explain the benefits achieved by abrupt discontinuities which are difficult to rationalize by guidance theory.

A further significant factor of the invention is that the major portion of the energy directed into the desired volume is direct radiation. While it is appreciated that a certain amount of indirect radiation is necessary, for example, to reach the surface of a large food load facing away from the antenna, and that such indirect energy may be effected by emphasizing the spreader effect, the major portion of the radiation relied upon in cooking is direct radiation. This is especially significant with batter loads, such as cakes or brownies, which are extremely sensitive to variations in radiated pattern. Because the major portion of the energy is direct radiation and evenly distributed, such batter loads are cooked with exceptional uniformity.

It will now be appreciated that what has been provided is a method and means for distributing microwave energy within a predetermined volume (that to be occupied by a microwave load), which serves to guide direct energy to the load, evenly distributing it, and requiring no moving parts for achieving such uniform energy distribution.

I claim as my invention:

1. In a microwave oven having a cooking cavity enclosing a predetermined volume within which a cooking load is to be located, a static monopole antenna for coupling energy to said cavity and distributing said energy within said volume, said antenna comprising a radiating member joining a cylindrical conductor, the antenna being positioned with the radiating member in the cavity and the cylindrical conductor projecting through an aperture in a wall of said cavity, means for coupling microwave energy to said cylindrical conductor for distribution by said radiating member, the radiating member having a base portion joining said cylindrical conductor and a tip portion on said base portion, the radiating member being symmetrical with the axis of said cylindrical conductor, the radiating member having a substantially continuous outer surface shaped to be circular in planes perpendicular to the axis with the cross sectional areas of said planes being varied to guide the radiation of energy, the base portion joining the cylindrical conductor at an angle in a range between about 90° and 180° with progressively decreasing angles in said range tending to spread the energy in said volume, the tip portion merging toward a point on said axis and forming an included angle in a range between about 20° and 150° with progressively decreasing angles in said range tending to concentrate center energy in said volume, said angles being coordinated to said predetermined volume to comprise said radiating member as means for balancing the spreading of energy and the concentrating of center energy to distribute primary radiation in said predetermined volume.

2. The microwave oven of claim 1 wherein the angle formed between the base portion and the cylindrical conductor is preferably in the range between 105° and 180°.

3. The microwave oven of claim 1 wherein the cylindrical conductor further includes an abrupt discontinuity for altering the distribution pattern.

4. The microwave oven of claim 1 wherein said base portion diverges from said cylindrical conductor for spreading energy in planes proximate said antenna, said tip portion being sharply pointed for concentrating center energy in planes distant said antenna, whereby the energy distribution coverage forms a substantial cube proximate said antenna.

5. The microwave oven of claim 1 wherein the angle formed between the cylindrical conductor and the base portion is substantially 180° for minimizing spreading of energy in planes proximate said antenna, the tip portion merging into a sharp point for concentrating energy in planes distant from said antenna, whereby the energy distribution coverage forms a shallow plane distant from said antenna.

6. The microwave oven of claim 1 wherein the angle formed between the cylindrical conductor and said base portion is substantially 180° for minimizing spreading of energy in planes proximate said antenna, the tip portion merging into a blunted point for concentrating center energy near said antenna, whereby the energy distribution coverage forms a small cube proximate said antenna.

7. The microwave oven of claim 1 wherein said base portion diverges from said cylindrical conductor for spreading energy in planes proximate said antenna, said tip portion being formed as a smoothly rounded curve tangents to which merge toward said point and postioned on said base portion for limiting center energy distant said antenna, whereby the energy distribution coverage forms a large shallow plane proximate said antenna.

8. The microwave oven of claim 1 wherein the base portion diverges from said cylindrical conductor to a plane of maximum diameter, said tip portion converging from the plane of maximum diameter to said point on the antenna axis, the base and tip portions being joined at the plane of maximum diameter, thereby to form a spreader-concentrator.

9. The microwave oven of claim 1 wherein the base portion diverges from the cylindrical conductor to a plane of maximum diameter, said tip portion being formed as a smoothly curved section tangents to which merge toward said point, said curved section joining the base portion at the plane of maximum diameter, said tip portion terminating in a blunted curved surface on the axis of said antenna, thereby to form a blunted spreader.

10. The microwave oven of claim 1 wherein said base portion forms an extension of the cylindrical conductor, said tip portion converging from the base portion to an apex on the antenna axis, thereby to form a concentrator.

11. The microwave oven of claim 1 wherein the base portion forms an extension of the cylindrical conductor, said tip portion converging in a continuous curve tangents to which merge toward said point, said curve terminating in a blunted surface on the axis of said antenna, thereby to form a blunted concentrator.

12. The microwave oven of claim 1 wherein the means for coupling energy comprises a coaxial feed including an outer cylindrical conductor and said cylindrical conductor, the maximum diameter of the radiating member being no greater than the diameter of said outer cylindrical conductor.

13. In a microwave system for delivering and distributing microwave energy within a predetermined enclosed volume, an improved static antenna comprising a coaxial feed including cylindrical inner and outer conductors, a radiating member coaxial with said inner conductor having a base portion joining said inner conductor and a tip portion on said base portion, the base portion joining the inner conductor at an angle in a range between about 90° and 180°, the tip portion merging to a point on said axis and forming an included angle in a range between about 20° and 150°, the radiating member being circular in any plane perpendicular to the axis thereof, the maximum diameter of the radiating member being no greater than the diameter of the outer conductor, the cross sectional area of said radiating member being varied to form said angles and provide guidance surfaces comprising means keyed to said predetermined volume for distributing microwave energy therein.

14. A method of distributing energy within a predetermined volume comprising the steps of providing an energy feed including an outer cylindrical conductor and an inner conductor coaxial therewith, forming a radiating antenna on said inner conductor including a base portion and a tip portion, diverging the base portion from the inner conductor by an amount sufficient to spread the energy to cover the planar area of the volume proximate the antenna, converging the tip portion from the base portion to the antenna axis by an amount sufficient to concentrate sufficient center energy in the volume, limiting the maximum antenna diameter to the diameter of said outer conductor, and balancing said converging and diverging steps to obtain a substantially uniform distribution of radiated energy in the predetermined volume.

15. The method as set forth in claim 14, further including the step of blunting the tip portion to decrease the concentration of center energy.

16. A method of distributing energy within a predetermined enclosed volume comprising the steps of providing an energy feed including a feed conductor for receiving said energy, forming a radiating antenna on and coaxial with said feed conductor with the radiating antenna being within said enclosed volume, shaping a base portion of said radiating antenna merging with said feed conductor at a first angle, adjusting the first angle in a range between 90° and 180° for spreading the energy in planes proximate the antenna, shaping a tip portion of said radiating antenna on the base portion merging toward a point on the axis, adjusting the included angle formed at said point in a range between 20° and 150° for concentrating center energy in planes more distant from the antenna, and balancing the first angle against the included angle to evenly distribute energy within said predetermined volume.

17. The method as set forth in claim 16 further including the step of blunting the tip portion to decrease the concentration of center energy.

18. The method as set forth in claim 17 wherein said energy feed includes an outer cylindrical conductor coaxial with said feed conductor, said method further including limiting the maximum diameter of said radiating antenna to the diameter of said outer conductor.

* * * * *